US010443404B2

(12) United States Patent
Roberts

(10) Patent No.: US 10,443,404 B2
(45) Date of Patent: Oct. 15, 2019

(54) FILM AND IMPINGEMENT PLATFORM COOLING FOR SERPENTINE COOLED TURBINE BLADES

(71) Applicant: Doosan Heavy Industries & Construction Co., Ltd., Gyeongsangnam-do (KR)

(72) Inventor: Steven M Roberts, Palm Beach Gardens, FL (US)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 220 days.

(21) Appl. No.: 15/469,000

(22) Filed: Mar. 24, 2017

(65) Prior Publication Data

US 2018/0274372 A1 Sep. 27, 2018

(51) Int. Cl.
*F01D 5/18* (2006.01)

(52) U.S. Cl.
CPC ..... *F01D 5/187* (2013.01); *F05D 2240/304* (2013.01); *F05D 2240/81* (2013.01); *F05D 2260/201* (2013.01); *F05D 2260/202* (2013.01)

(58) Field of Classification Search
CPC ..... F01D 5/187; F05D 2260/202; F05D 2260/201; F05D 2240/81; F05D 2240/304
USPC ..... 416/97 R
See application file for complete search history.

(56) References Cited

U.S. PATENT DOCUMENTS 3,834,831 A * 9/1974 Mitchell ..... F01D 5/081 416/193 A
6,945,749 B2 * 9/2005 De Cardenas ..... F01D 5/081 415/115
7,293,961 B2 * 11/2007 Lee ..... F01D 5/187 415/115
7,322,797 B2 * 1/2008 Lee ..... F01D 5/22 415/115
7,713,027 B2 * 5/2010 Cherolis ..... F01D 5/187 416/97 R
8,591,189 B2 * 11/2013 Correia ..... F01D 5/187 416/96 R
8,905,714 B2 * 12/2014 Ellis ..... F01D 5/187 416/97 R (Continued)

FOREIGN PATENT DOCUMENTS

JP 2007154898 A 6/2007

OTHER PUBLICATIONS

A Korean Office Action dated May 3, 2019 in connection with Korean Patent Application No. 10-2018-0032037 which corresponds to the above-referenced U.S. application.

*Primary Examiner* — Hai H Huynh
(74) *Attorney, Agent, or Firm* — Invenstone Patent, LLC

(57) ABSTRACT

A serpentine turbine blade can include: a platform having a top surface; an air foil on the top surface of the platform; a trailing edge turnaround formed in the platform; and a filmhole formed in the platform, wherein the filmhole is connected to the trailing edge turnaround through an impingement cavity in the platform. The air foil includes an internal cooling cavity providing a coolant to the trailing edge turnaround. The impingement cavity comprises a pre-impingement cavity connected to the trailing edge turnaround, a post-impingement cavity connected to the filmhole, and an impingement slot connecting the pre-impingement cavity and the post-impingement cavity to each other.

20 Claims, 6 Drawing Sheets

(56) References Cited

U.S. PATENT DOCUMENTS 9,810,070 B2 * 11/2017 Johns ..... F01D 5/081

* cited by examiner

FILM AND IMPINGEMENT PLATFORM COOLING FOR SERPENTINE COOLED TURBINE BLADES

BACKGROUND OF THE INVENTION

A gas turbine generally comprises a compressor, a combustor, and a turbine, wherein the compressor provides compressed air generated by a plurality of compressor blades to the combustor, the compressed air is combusted with fuel in the combustor to generate hot gas, and the hot gas is provided to the turbine such that a plurality of turbine blades turn. The surface temperature of the plurality of turbine blades becomes very high due to the hot gas passing through the turbine blades, and the hot temperature of the turbine blades causes coating spallation and oxidation of the turbine blades. In addition, as a result of the hot surface temperature, a platform of the turbine blades tends to bow and becomes weak due to cracking. Thus, in the conventional design, a serpentine cooled turbine is used in such a manner that coolant passes through the inside of the turbine blades in order to lower the temperature. However, the temperature of the turbine blades is not decreased efficiently enough to sufficiently inhibit the coating spallation and cracking.

BRIEF SUMMARY

The present invention relates to a turbine blade for a gas turbine, more particularly, to a serpentine cooled turbine blade including an impingement cavity in a platform and a filmhole on a top surface of the platform.

In many embodiments, a turbine blade comprises an impingement cavity in a platform and a filmhole on a top surface of the platform such that a coolant flows to the filmhole through the impingement cavity.

In an embodiment of the present invention, a turbine blade can include: a platform; an air foil on the platform; an internal cooling cavity passing through the platform and the air foil; a pre-impingement cavity disposed in the platform and connected to the internal cooling cavity; and a post-impingement cavity disposed in the platform and connected to the pre-impingement cavity.

In another embodiment of the present invention, a serpentine turbine blade can include: a platform having a top surface; an air foil on the top surface of the platform; a trailing edge turnaround formed in the platform; and a filmhole formed in the platform, wherein the filmhole is connected to the trailing edge turnaround through an impingement cavity in the platform.

In yet another embodiment of the present invention, a gas turbine can include: a platform; a body disposed on a bottom surface of the platform; an air foil disposed on a top surface of the platform; an internal cooling cavity disposed in the air foil and the platform; a filmhole disposed on the top surface of the platform; a pre-impingement cavity formed in the platform and connected to the internal cooling cavity; and a post-impingement cavity formed in the platform and connected to the pre-impingement cavity and the filmhole.

BRIEF DESCRIPTION OF THE DRAWINGS

FIG. 3(*b*) shows a partial inside view of a serpentine turbine blade.

FIG. 4(*b*) shows a perspective partial inside view of a serpentine turbine blade according to an embodiment of the subject invention.

FIG. 6(*b*) shows a cross-sectional view taken along line C-C in FIG. 5, of a serpentine turbine blade according to an embodiment of the subject invention.

DETAILED DISCLOSURE

Figure 1:
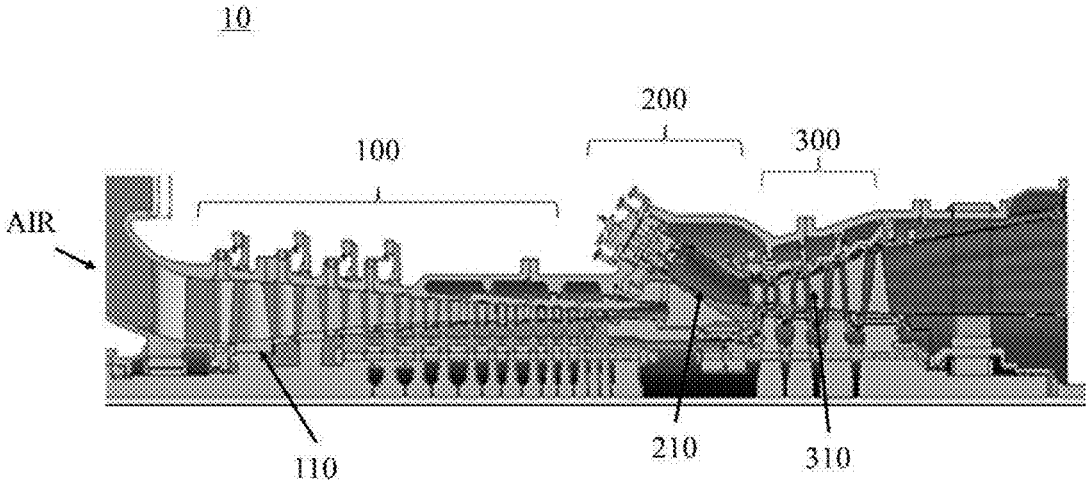
FIG. 1 shows a cross-sectional view of a gas turbine.

When the terms "on" or "over" are used herein, when referring to layers, regions, patterns, or structures, it is understood that the layer, region, pattern, or structure can be directly on another layer or structure, or intervening layers, regions, patterns, or structures may also be present. When the terms "under" or "below" are used herein, when referring to layers, regions, patterns, or structures, it is understood that the layer, region, pattern, or structure can be directly under the other layer or structure, or intervening layers, regions, patterns, or structures may also be present. The terms "includes" and "including" are equivalent to "comprises" and "comprising," respectively.

In addition, references to "first", "second", and the like (e.g., first and second portion), as used herein, and unless otherwise specifically stated, are intended to identify a particular feature of which there may be more than one. Such reference to "first" does not imply that there must be two or more. These references are not intended to confer any order in time, structural orientation, or sidedness (e.g., left or right) with respect to a particular feature, unless explicitly stated. In addition, the terms "first" and "second" can be selectively or exchangeably used for the members.

Furthermore, "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated. That is, a dimension of each of the elements may be exaggerated for clarity of illustration, and the dimension of each of the elements may be different from an actual dimension of each of the elements. Not all elements illustrated in the drawings must be included and limited to the present disclosure, but the elements except essential features of the present disclosure may be added or deleted.

It is to be understood that the figures and descriptions of embodiments of the present invention have been simplified to illustrate elements that are relevant for a clear understanding of the invention, while eliminating (in certain cases), for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

Reference will be made to the attached figures on which the same reference numerals are used throughout to indicate the same or similar components. With reference to the attached figures, which show certain embodiments of the subject invention, it can be seen in FIG. 1 that, in an embodiment, a gas turbine 10 includes a compressor 100 having a compressor blade 110, a combustor 200 having a combustion chamber 210, and a turbine 300 having a turbine blade 310. Air is provided according to the arrow direction to the compressor blade 110 and compressed in the compressor 100, and then the compressed air is provided to the combustor 200. The compressed air provided by the compressor 100 is combusted with a fuel in the combustion chamber 210, thereby producing a hot gas. The hot gas generated in the combustion chamber 210 is supplied to the turbine blade 310 such that the turbine blade 310 turns. That is, the turbine blade 310 turns by the hot gas.

Figure 2:
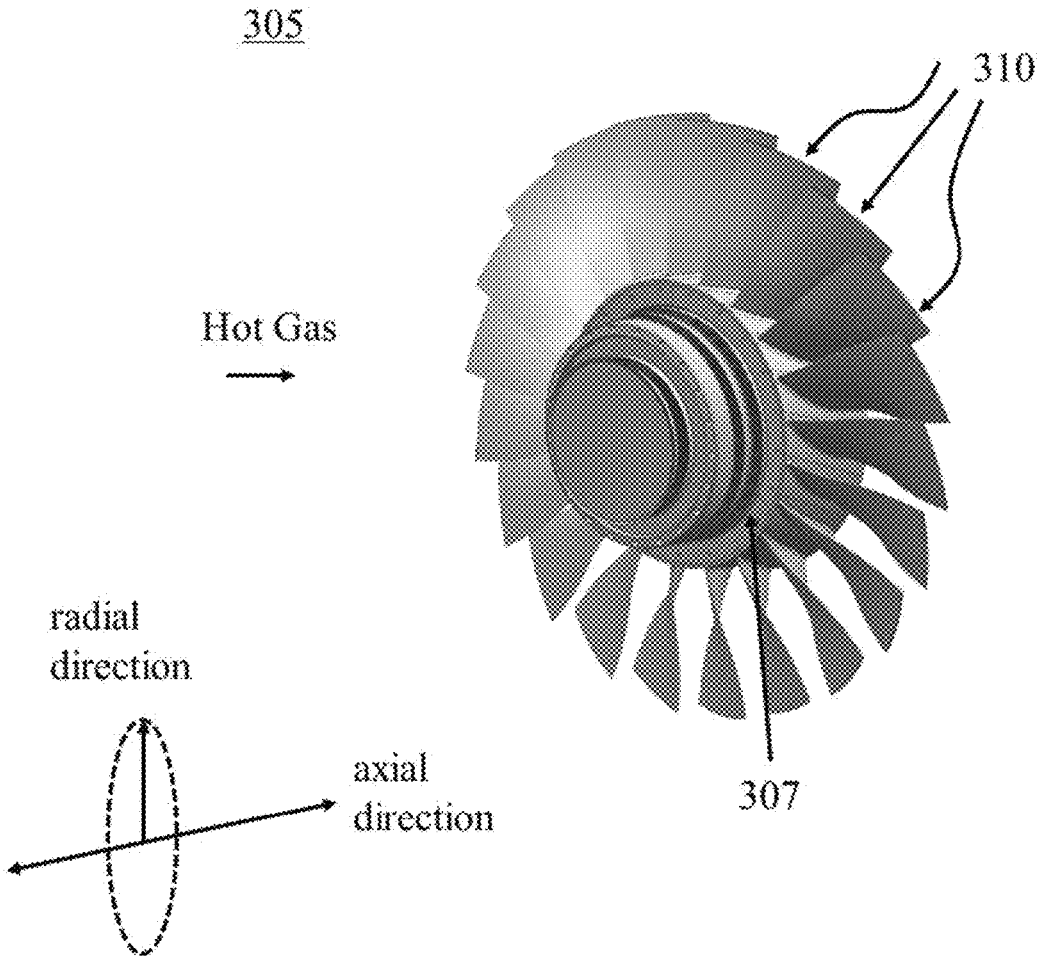
FIG. 2 shows a perspective view of a turbine bladed disk.

FIG. 2 shows a perspective view of a turbine bladed disk. Referring to FIGS. 1 and 2, the turbine 300 includes a turbine bladed disk 305 that comprises a disk 307 and a plurality of turbine blades 310 attached to the disk 307 in a radial direction. When the hot gas passes through the turbine blades 310 according to an axial direction, the turbine blades 310 and the disk 307 are turned by the passing hot gas.

Figure 3A:
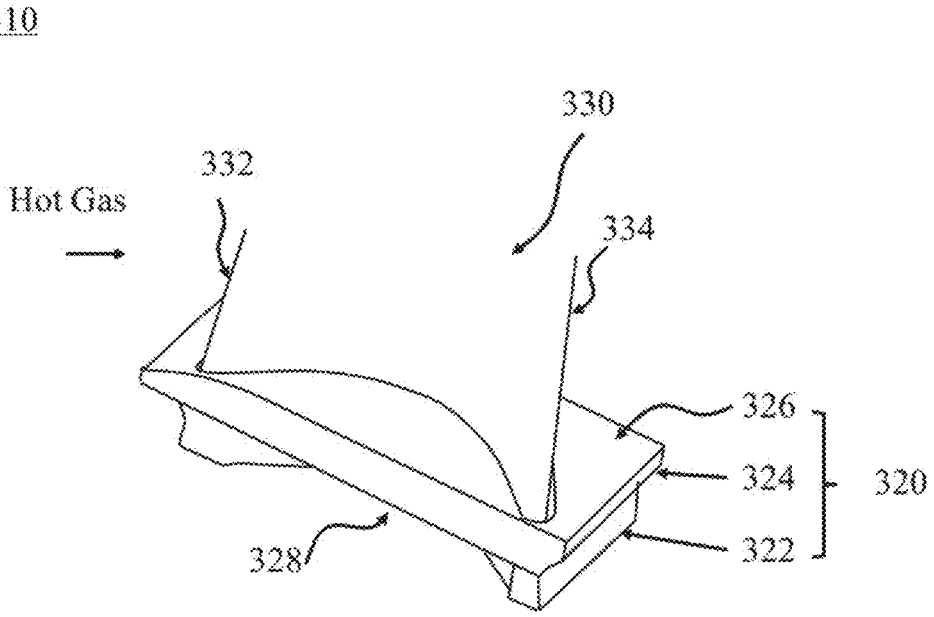
FIG. 3(*a*) shows a perspective view of a serpentine turbine blade.
Figure 3B:
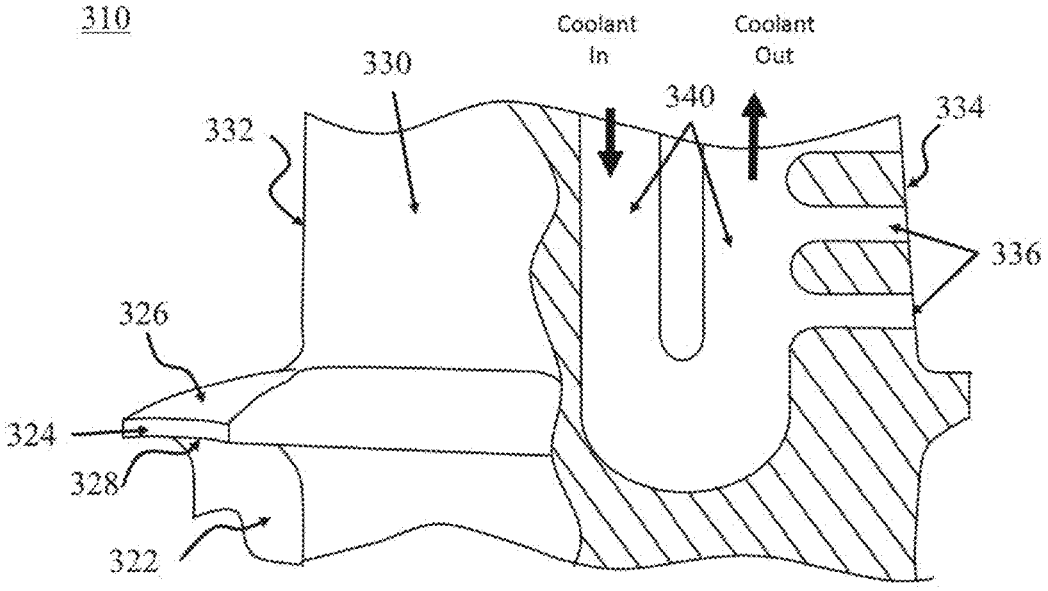

FIG. 3(*a*) shows a perspective view of a serpentine turbine blade. The turbine blade 310 comprises an attachment 320 configured to be attached to a disk of a turbine bladed disk and an air foil 330 disposed on the attachment 320. In particular, the attachment 320 includes a body 322 and a platform 324, wherein the body 322 is disposed on a bottom surface 328 of the platform 324 and the air foil 330 is disposed on a top surface 326 of the platform 324. The hot gas flows from a leading edge 332 of the air foil 330 to a trailing edge 334 of the air foil 330, thereby generating lift and turning the turbine blade 310. When the hot gas passes the air foil 330, while the top surface 326 of the platform 324 is exposed to the hot gas, the bottom surface 328 of the platform 324 is not exposed to the hot gas. As a result, a temperature of the top surface 326 and a temperature of the bottom surface 328 are different from each other. In addition, a platform region around the trailing edge 334 is subjected to very high heat loads due to gas-path migration effect as the hot gas originating from a mid-span of the leading edge 332 surrounds the platform region around the trailing edge 334. This uneven heat distribution leads to premature thermal barrier coating (TBC) spallation and substrate oxidation. In addition, the platform 324 tends to bow due to the associated radial temperature gradient across the top surface 326 and the bottom surface 328, essentially pulling away from the air foil 330, thereby inducing a high stress field in the platform 324 and causing premature low-cycle fatigue (LCF) cracking.

FIG. 3(*b*) shows a partial inside view of a serpentine turbine blade. The turbine blade 310 including an internal cooling cavity made in a serpentine shape is known as a serpentine turbine blade. The serpentine turbine blade 310 includes an internal cooling cavity 340 formed inside the air foil 330 and the platform 324, and a plurality of trailing edge slots 336 formed on the trailing edge 334. The trailing edge slots 336 are connected to the internal cooling cavity 340, thus a coolant passes through the internal cooling cavity 340 and flows out the trailing edge slots 336. Referring to FIGS. 3(*a*) and 3(*b*), though the coolant passes inside the air foil 330 and the platform 324 through the internal cooling cavity 340, most of the top surface 326 of the platform 324 is spaced apart from the coolant passing through the internal cooling cavity 340, and the temperature of the top surface 326 is not lowered effectively.

Figure 4A:
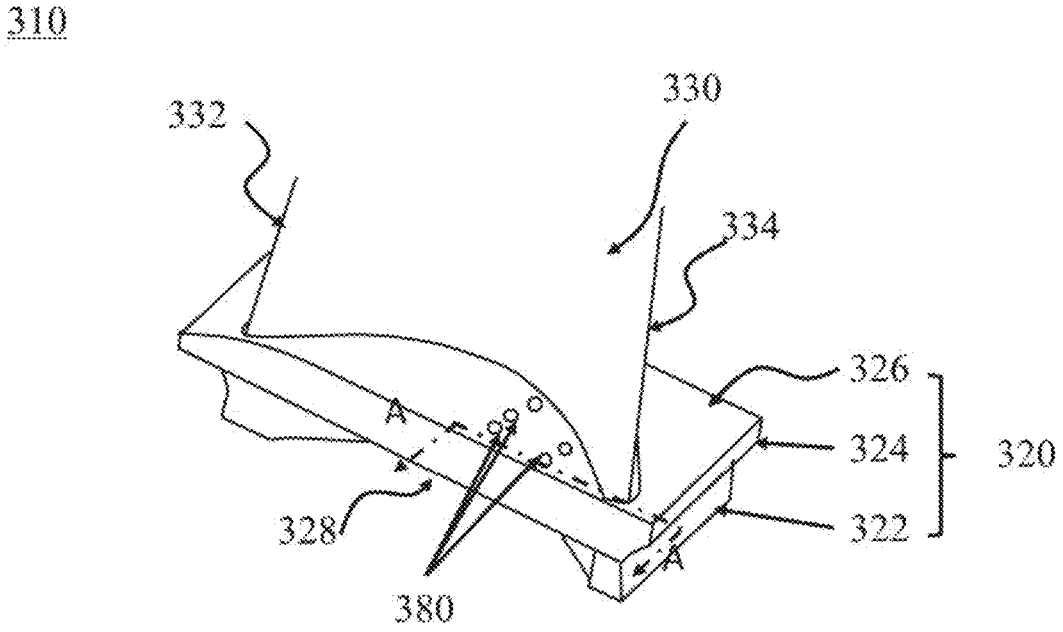
FIG. 4(*a*) shows a perspective view of a serpentine turbine blade according to an embodiment of the subject invention.
Figure 4B:
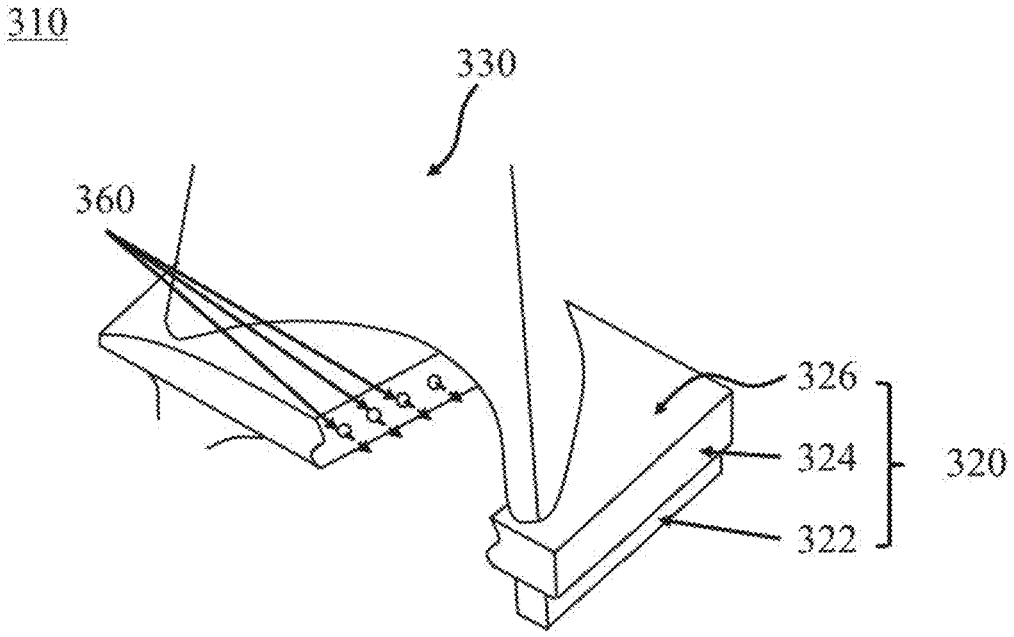

FIG. 4(*a*) shows a perspective view of a serpentine turbine blade according to an embodiment of the subject invention. Referring to FIG. 4(*a*), the turbine blade 310 comprises an attachment 320 including a body 322 and a platform 324, and an air foil 330 disposed on the attachment 320. The body 322 configured to be attached to a disk is disposed on a bottom surface 328 of the platform 324 and the air foil 330 is disposed on a top surface 326 of the platform 324. In addition, the turbine blade 310 further comprises a filmhole 380 that provides a path for a coolant. The filmhole 380 is disposed on the top surface 326 of the platform 324 and the coolant passing though the filmhole 380 inhibits a temperature of the top surface 326 from increasing. The filmhole 380 is located on the top surface 326 between a leading edge 332 of the air foil 330 and a trailing edge 334 of the air foil 330. In this particular embodiment, the filmhole 380 is closer to the trailing edge 334 than the leading edge 332, but is not limited to a particular position.

FIG. 4(*b*) shows a perspective partial inside view of a serpentine turbine blade according to an embodiment of the subject invention. Referring to FIG. 4(*b*), the turbine blade 310 includes an impingement slot 360 inside the platform 324. The coolant passes through the impingement slot 360, thereby inhibiting the temperature of the platform 324 from increasing. The coolant passing through the impingement slot 360 can flow though the filmhole 380 of FIG. 4(*a*).

Figure 5:
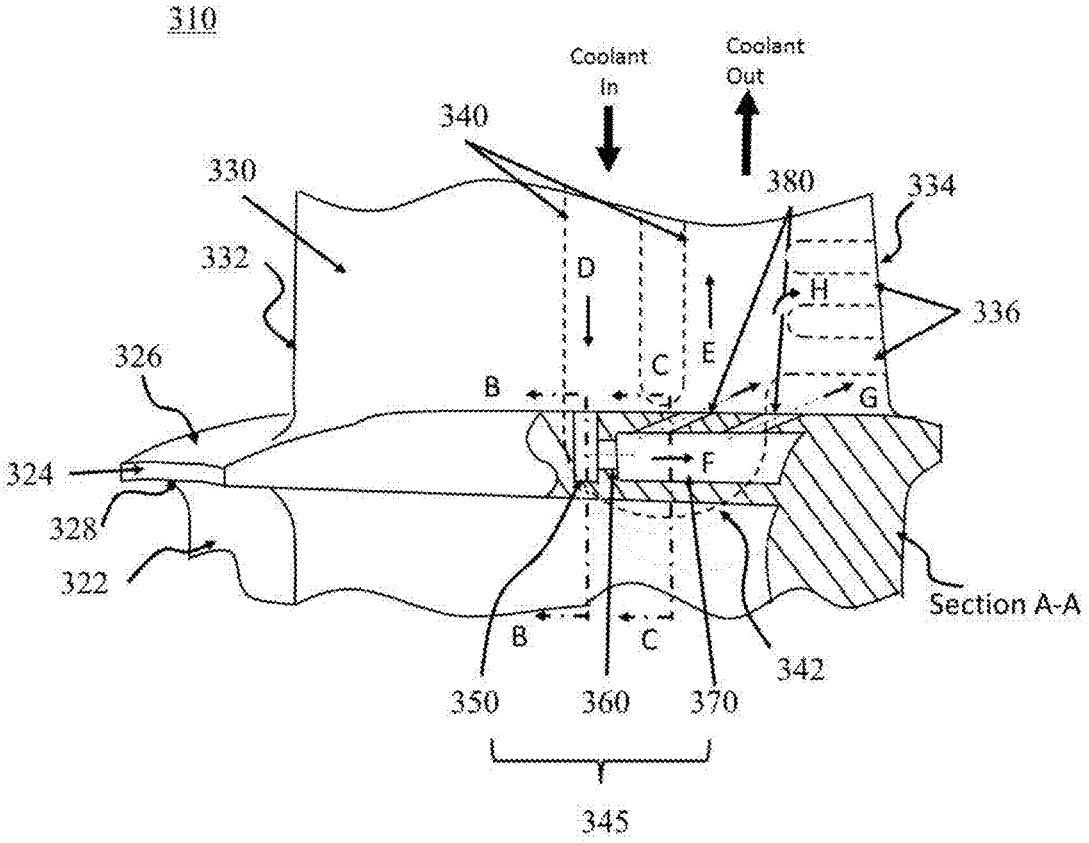
FIG. 5 shows a partial cross-sectional view of a serpentine turbine blade according to an embodiment of the subject invention.

FIG. 5 shows a partial cross-sectional view of a serpentine turbine blade according to an embodiment of the subject invention, more particularly, a partial inside view of the turbine blade taken along line A-A in FIG. 4(*a*). The turbine blade 310 comprises a platform 324, a body 322 disposed on a bottom surface 328 of the platform 324, an air foil 330 disposed on a top surface 326 of the platform 324, and an impingement cavity 345 formed inside the platform 324. The turbine blade 310 further comprises a filmhole 380 on the top surface 326, an internal cooling cavity 340 formed inside the air foil 330 and the platform 324, and a trailing edge slot 336 formed inside the air foil 330.

The impingement cavity 345 includes a pre-impingement cavity 350 connected to the internal cooling cavity 340, a post-impingement cavity 370 connected to the filmhole 380, and an impingement slot 360 connecting the pre-impingement cavity 350 to the post-impingement cavity 370. That is, the impingement slot 360 separates the pre-impingement cavity 350 and the post-impingement cavity 370.

The internal cooling cavity 340 has a serpentine shape and changes a path around a trailing edge turnaround 342 that is placed inside the platform 324 such that the pre-impingement cavity 370 is connected to the internal cooling cavity 340 through the trailing edge turnaround 342. One end of the trailing edge slot 336 is connected to the internal cooling cavity 340 in the air foil 330 and the other end of the trailing edge slot 336 is placed on a trailing edge 334 while facing the outside of the air foil 330.

When a coolant flows into the internal cooling cavity 340 as indicated by an arrow D, a first portion of the coolant flows to the pre-impingement cavity 350, and then passes through the impingement slot 360 and the post-impingement cavity 370 as indicated by an arrow F. Finally, the first portion of the coolant flows outside the top surface 326 of the platform 324 through the filmhole 380 as indicated by an arrow G A second portion of the coolant changes its flow direction in the trailing edge turnaround 342 and flows in the internal cooling cavity 340 according to an arrow After then, the second portion of the coolant flows outside the air foil 330 through the trailing edge slot 336 as shown by an arrow H. That is, the first portion of the coolant passes inside the platform 324 and then flows outside the top surface 326 of the platform 324, thereby inhibiting a temperature of the platform 324 from increasing.

The impingement cavity 345 including the pre-impingement cavity 350, the impingement slot 360, and the post-impingement cavity 370 is formed by a cast-in type within the platform 324. In addition, the filmhole 380 is also formed by the case-in type. That is, the impingement cavity 345 and the filmhole 380 are made with the platform 324 together.

Figure 6A:
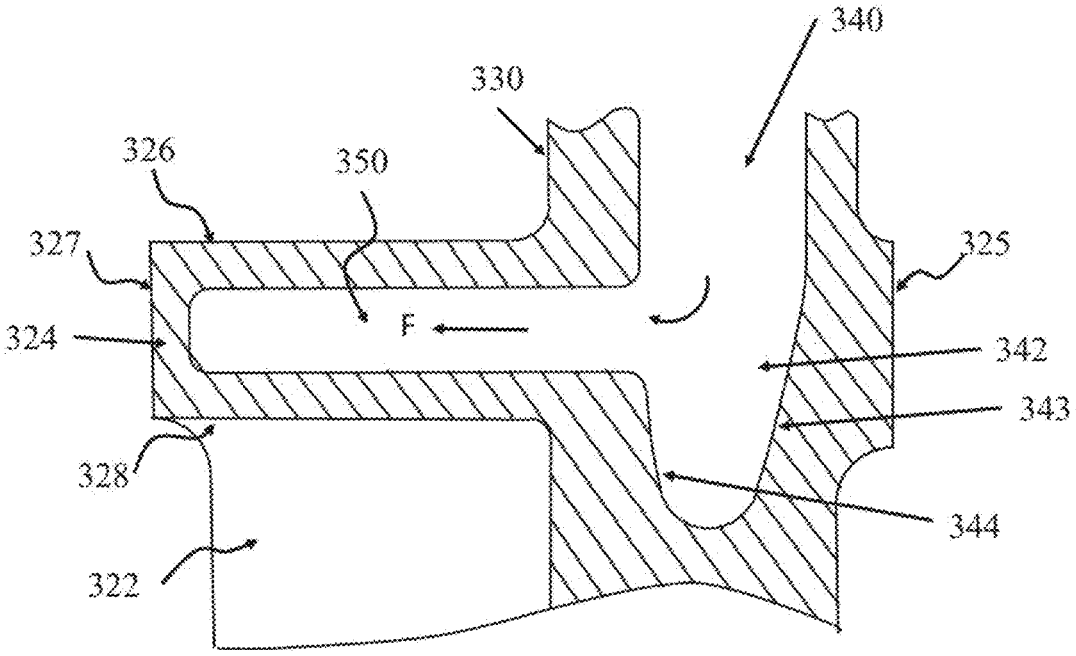
FIG. 6(*a*) shows a cross-sectional view taken along line B-B in FIG. 5, of a serpentine turbine blade according to an embodiment of the subject invention.
Figure 6B:
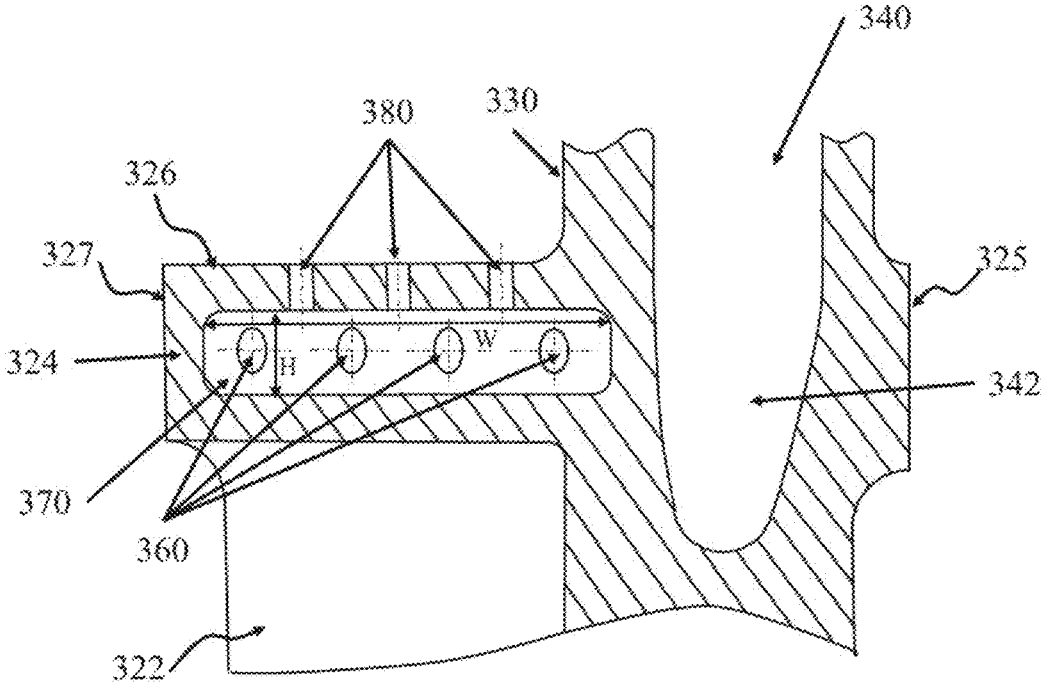

FIG. 6(*a*) shows a cross-sectional view taken along line B-B in FIG. 5, of a serpentine turbine blade according to an embodiment of the subject invention. Referring to FIG. 6(*a*), the pre-impingement cavity 350 is directly connected to the internal cooling cavity 340, more particularly, to the trailing edge turnaround 342 of the internal cooling cavity 340. The air foil 330 and the internal cooling cavity 340 are placed in a first side 325 of the platform 324, thus the coolant is initially provided in the first side 325 of the platform 324. However, the pre-impingement cavity 350 extends from the first side 325 of the platform 324 to a second side 327 of the platform 324, thereby providing a first portion of the coolant in the internal cooling cavity 340 to the second side 327 of the platform 324 according to the arrow F. A distal end of the trailing edge turnaround 342 extends to the body 322, thus the distal end of the trailing edge turnaround 342 is placed lower than the pre-impingement cavity 350 and the bottom surface 328 of the platform 324. The trailing edge turnaround 342 have an asymmetric shape such that a first surface 343 facing the first side 325 is inclined more than a second surface 344 facing the second side 327, thus helping the first portion of the coolant to enter the pre-impingement cavity 350.

FIG. 6(*b*) shows a cross-sectional view taken along line C-C in FIG. 5, of a serpentine turbine blade according to an embodiment of the subject invention. Referring to FIG. 6(*b*), the post-impingement cavity 370 is placed in the platform 324 closer to the second side 327 than the first side 325. The post-impingement cavity 370 is spaced apart from the trailing edge turnaround 342 but is configured to be connected to the pre-impingement cavity 350 of FIG. 6(*a*) through the impingement slot 360 such that the first portion of the coolant provided by the trailing edge turnaround 342 flows into the post-impingement cavity 370. In addition, the filmhole 380 passes through the platform 324 from the post-impingement cavity 370 to the top surface 326, thereby providing a path for the first portion of the coolant to flow outside the platform 324. A cross-sectional area of the impingement slot 360 is smaller than a height H of the post-impingement cavity 370 and a width of the filmhole 380 is narrower than a width W of the post-impingement cavity 370. The impingement slot 360 functioning as an inlet of the post-impingement cavity 370 is not aligned with the filmhole 380 functioning as an outlet of the post-impingement cavity 370, but the filmhole 380 may be placed between adjacent two impingement slots 360.

Referring to FIGS. 4(*b*) and 6(*b*), the impingement slot 360 comprises a plurality of impingement slots and the plurality of impingement slots are extended in parallel. Referring to FIGS. 4(*a*) and 6(*b*), the filmhole 380 comprises a plurality of filmholes and the plurality of filmholes are placed in a matrix form.

The subject invention includes, but is not limited to, the following exemplified embodiments.

Embodiment 1

A turbine blade, comprising:

a platform;

an air foil on the platform;

an internal cooling cavity passing through the platform and the air foil;

a pre-impingement cavity disposed in the platform and connected to the internal cooling cavity; and a post-impingement cavity disposed in the platform and connected to the pre-impingement cavity.

Embodiment 2

The turbine blade according to embodiment 1, further comprising an impingement slot connecting the pre-impingement cavity to the post-impingement cavity.

Embodiment 3

The turbine blade according to embodiment 2, wherein the pre-impingement cavity is directly connected to a trailing edge turnaround of the internal cooling cavity.

Embodiment 4

The turbine blade according to embodiment 3, wherein the air foil includes a trailing edge slot on a trailing edge.

Embodiment 5

The turbine blade according to embodiment 4, wherein a first portion of a coolant in the internal cooling cavity flows to the post-impingement cavity through the pre-impingement cavity and a second portion of the coolant in the internal cooling cavity flows to the trailing edge slot.

Embodiment 6

The turbine blade according to any of embodiments 1-5, further comprising a body disposed on a bottom surface of the platform, wherein the air foil is disposed on a top surface of the platform.

Embodiment 7

The turbine blade according to embodiment 6, wherein a distal end of the trailing edge turnaround is located in the body.

Embodiment 8

The turbine blade according to any of embodiments 5-7, further comprising a filmhole formed on the top surface of the platform and connected to the post-impingement cavity such that the first portion of the coolant flows through the filmhole.

Embodiment 9

A serpentine turbine blade, comprising:

a platform having a top surface;

an air foil on the top surface of the platform;

a trailing edge turnaround formed in the platform; and a filmhole formed in the platform, wherein the filmhole is connected to the trailing edge turnaround through an impingement cavity in the platform.

Embodiment 10

The serpentine turbine blade according to embodiment 9, wherein the filmhole passes through the platform from the impingement cavity to the top surface of the platform.

Embodiment 11

The serpentine turbine blade according to any of embodiments 9-10, wherein the air foil includes an internal cooling cavity providing a coolant to the trailing edge turnaround.

Embodiment 12

The serpentine turbine blade according to any of embodiments 9-11, wherein the impingement cavity comprises a pre-impingement cavity connected to the trailing edge turnaround, a post-impingement cavity connected to the filmhole, and an impingement slot connecting the pre-impingement cavity and the post-impingement cavity to each other.

Embodiment 13

The serpentine turbine blade according to embodiment 12, wherein a cross-sectional area of the impingement slot is smaller than a height of the post-impingement cavity.

Embodiment 14

The serpentine turbine blade according to any of embodiments 11-13, wherein the air foil includes a trailing edge slot on a trailing edge and the trailing edge slot is connected to the internal cooling cavity.

Embodiment 15

The serpentine turbine blade according to embodiment 14, wherein the filmhole is placed between a leading edge of the air foil and the trailing edge of the air foil.

Embodiment 16

A gas turbine, comprising:

a platform;

a body disposed on a bottom surface of the platform;

an air foil disposed on a top surface of the platform;

an internal cooling cavity disposed in the air foil and the platform;

a filmhole disposed on the top surface of the platform;

a pre-impingement cavity formed in the platform and connected to the internal cooling cavity; and a post-impingement cavity formed in the platform and connected to the pre-impingement cavity and the filmhole.

Embodiment 17

The gas turbine according to embodiment 16, wherein the internal cooling cavity includes a trailing edge turnaround formed in the platform and changes a path around the trailing edge turnaround.

Embodiment 18

The gas turbine according to embodiment 17, wherein the pre-impingement cavity is connected to the trailing edge turnaround.

Embodiment 19

The gas turbine according to any of embodiments 16-18, wherein the post-impingement cavity is spaced apart from the internal cooling cavity.

Embodiment 20

The gas turbine according to any of embodiments 16-19, wherein the air foil comprises a leading edge facing a hot gas and a trailing edge connected to the internal cooling cavity.

Embodiment 21

The gas turbine according to embodiment 20, wherein the air foil includes a trailing edge slot on the trailing edge.

Embodiment 22

The gas turbine according to embodiment 21, wherein the trailing edge slot is connected to the internal cooling cavity.

Embodiment 23

A serpentine turbine blade, comprising:

a platform having a top surface;

an air foil on the top surface of the platform;

an internal cooling cavity formed in the platform and the air foil; and a filmhole formed on the top surface of the platform, wherein the filmhole is connected to the internal cooling cavity such that a coolant flows from the internal cooling cavity to the filmhole.

Embodiment 24

The serpentine turbine blade according to embodiment 23, further comprising an impingement slot formed in the platform, wherein the coolant flows from the internal cooling cavity to the filmhole through the impingement slot.

Embodiment 25

The serpentine turbine blade according to any of embodiments 23-24, further comprising a trailing edge slot formed on a trailing e of the air foil and connected to the internal cooling cavity.

Embodiment 26

A gas turbine comprising the serpentine turbine blade according to any of embodiments 23-25.

It should be understood that the examples and embodiments described herein are for illustrative purposes only and that various modifications or changes in light thereof will be suggested to persons skilled in the art and are to be included within the spirit and purview of this application. Thus, the invention is not intended to limit the examples described herein, but is to be accorded the widest scope consistent with the principles and novel features disclosed herein.

What is claimed is:

1. A turbine blade, comprising:

a platform having an internal cooling cavity extended from an air foil, a pre-impingement, an impingement slot, and a post-impingement cavity through each of which a coolant flows to thereby lower a temperature of a platform and turbine blade, where the internal cooling cavity, the pre-impingement, the impingement slot, and the post-impingement cavity form a closed passage along which a coolant flows;

the air foil disposed and formed on the platform;

the internal cooling cavity formed inside the platform and the air foil such that a coolant flows along the internal cooling cavity by passing through the platform and the air foil;

the pre-impingement cavity disposed inside a first portion of the platform in a shape extended to a width direction of the platform, and connected to the internal cooling cavity, such that the coolant passing the internal cooling cavity flows into the pre-impingement cavity; and the post-impingement cavity disposed inside a second portion of the platform in a shape extended to a width direction of the platform, and connected to the pre-impingement cavity, such that the coolant passing the internal cooling cavity flows into the pre-impingement cavity.

2. The turbine blade according to claim 1, further comprising the impingement slot disposed inside the platform and connecting the pre-impingement cavity to the post-impingement cavity, such that the coolant passing the pre-impingement cavity flows into the pre-impingement cavity through the impingement.

3. The turbine blade according to claim 2, wherein the pre-impingement cavity is directly connected to a trailing edge turnaround of the internal cooling cavity.

4. The turbine blade according to claim 3, wherein the air foil includes a trailing edge slot on a trailing edge.

5. The turbine blade according to claim 4, wherein a first portion of the coolant in the internal cooling cavity flows to the post-impingement cavity through the pre-impingement cavity and a second portion of the coolant in the internal cooling cavity flows to the trailing edge slot.

6. The turbine blade according to claim 5, further comprising a body disposed on a bottom surface of the platform, wherein the air foil is disposed on a top surface of the platform.

7. The turbine blade according to claim 6, wherein a distal end of the trailing edge turnaround is located in the body.

8. The turbine blade according to claim 7, further comprising a filmhole formed on the top surface of the platform and connected to the post-impingement cavity such that the first portion of the coolant flows through the post-impingement cavity into the filmhole.

9. A serpentine turbine blade, comprising:

a platform having an internal cooling cavity extended from an air foil, a pre-impingement, an impingement slot, and a post-impingement cavity through each of which a coolant flows to thereby lower a temperature of a platform and turbine blade, where the internal cooling cavity, the pre-impingement, the impingement slot, and the post-impingement cavity form a closed passage along which a coolant flows;

the air foil disposed and formed on a top surface of the platform;

a trailing edge turnaround formed inside a first portion of the platform; and a filmhole formed in the platform, and connected to post-impingement cavity, such that the coolant passing the post-impingement cavity flows into the top surface of the platform, wherein the filmhole is connected to the trailing edge turnaround through the post-impingement cavity in the platform.

10. The serpentine turbine blade according to claim 9, wherein the filmhole passes through the platform from the post-impingement cavity to the top surface of the platform.

11. The serpentine turbine blade according to claim 10, wherein the air foil includes the internal cooling cavity providing the coolant to the trailing edge turnaround.

12. The serpentine turbine blade according to claim 11, wherein the pre-impingement cavity is connected to the trailing edge turnaround, the post-impingement cavity is connected to the filmhole, and the impingement slot connects the pre-impingement cavity and the post-impingement cavity to each other.

13. The serpentine turbine blade according to claim 12, wherein a cross-sectional area of the impingement slot is smaller than a height of the post-impingement cavity.

14. The serpentine turbine blade according to claim 12, wherein the air foil includes a trailing edge slot on a trailing edge and the trailing edge slot is connected to the internal cooling cavity.

15. The serpentine turbine blade according to claim 14, wherein the filmhole is placed between a leading edge of the air foil and the trailing edge of the air foil.

16. A gas turbine, comprising:

a platform having an internal cooling cavity extended from an air foil, a pre-impingement, an impingement slot, and a post-impingement cavity through each of which a coolant flows to thereby lower a temperature of a platform and turbine blade, where the internal cooling cavity, the pre-impingement, the impingement slot, and the post-impingement cavity form a closed passage along which a coolant flows;

a body disposed on a bottom surface of the platform;

the air foil disposed and formed on a top surface of the platform;

the internal cooling cavity formed inside the air foil and the platform such that a coolant flows along the internal cooling cavity by passing through the air foil and the platform;

a filmhole disposed on the top surface of the platform;

the pre-impingement cavity formed inside a first portion of the platform in a shape extended to a width direction of the platform, and connected to the internal cooling cavity, such that the coolant passing the internal cooling cavity flows into the pre-impingement cavity; and the post-impingement cavity formed inside a second portion of the platform in a shape extended to a width direction of the platform, and connected to the pre-impingement cavity and the filmhole, such that the coolant passing the internal cooling cavity flows into the pre-impingement cavity.

17. The gas turbine according to claim 16, wherein the internal cooling cavity includes a trailing edge turnaround formed in the platform and changes a path around the trailing edge turnaround.

18. The gas turbine according to claim 17, wherein the pre-impingement cavity is connected to the trailing edge turnaround.

19. The gas turbine according to claim 18, wherein the post-impingement cavity is spaced apart from the internal cooling cavity.

20. The gas turbine according to claim 16, wherein the air foil comprises a leading edge facing a hot gas and a trailing edge connected to the internal cooling cavity.

* * * * *